US010551036B2

(12) United States Patent
Palmano

(10) Patent No.: US 10,551,036 B2
(45) Date of Patent: Feb. 4, 2020

(54) LIGHT UNIT

(71) Applicant: Plumen Limited, London (GB)

(72) Inventor: Buster Palmano, London (GB)

(73) Assignee: Plumen Limited, London (GB)

( * ) Notice: Subject to any disclaimer, the term of this patent is extended or adjusted under 35 U.S.C. 154(b) by 0 days.

(21) Appl. No.: 16/075,765

(22) PCT Filed: Jan. 19, 2017

(86) PCT No.: PCT/GB2017/050130
§ 371 (c)(1),
(2) Date: Aug. 6, 2018

(87) PCT Pub. No.: WO2017/144843
PCT Pub. Date: Aug. 31, 2017

(65) Prior Publication Data

US 2019/0041037 A1 Feb. 7, 2019

(30) Foreign Application Priority Data

Feb. 23, 2016 (GB) ..... 1603101.5

(51) Int. Cl.

| | |
|---|---|
| ***F21V 13/04*** | (2006.01) |
| ***F21V 7/00*** | (2006.01) |
| ***F21V 19/00*** | (2006.01) |
| ***F21V 17/06*** | (2006.01) |
| *F21Y 115/10* | (2016.01) |

(52) U.S. Cl.
CPC ..... *F21V 13/04* (2013.01); *F21V 7/0033* (2013.01); *F21V 7/0066* (2013.01); *F21V 17/06* (2013.01); *F21V 19/0035* (2013.01); *F21Y 2115/10* (2016.08)

(58) Field of Classification Search
CPC ..... F21V 13/04; F21V 17/06; F21V 19/0035; F21V 7/0033; F21V 7/0066
USPC ..... 362/368
See application file for complete search history.

(56) References Cited

U.S. PATENT DOCUMENTS

| | | | | |
|---|---|---|---|---|
| 5,173,810 A * | 12/1992 | Yamakawa | ..... | F21V 5/04 250/216 |
| 5,768,649 A * | 6/1998 | Pearson | ..... | G03B 19/04 359/819 |
| 6,536,921 B1 | 3/2003 | Simon | | |
| 6,598,998 B2 * | 7/2003 | West | ..... | H01L 33/58 257/E33.073 |

(Continued)

FOREIGN PATENT DOCUMENTS

| | | | | |
|---|---|---|---|---|
| DE | 202012008322 | 9/2012 | | |
| EP | 2177824 A1 * | 4/2010 | ..... | F21V 17/164 |
| WO | WO2014094061 | 6/2014 | | |

*Primary Examiner* — Robert J May
*Assistant Examiner* — Leah Simone Macchiarolo
(74) *Attorney, Agent, or Firm* — Stetina Brunda Garred & Brucker

(57) ABSTRACT

A light unit for general purpose or decorative lighting having a directional light source, a light transmissive optic arranged to direct light from the light source and a plurality of reflectors arranged to receive light from the optic and/or light source and at least partially a reflect portion of the light in a predetermined distribution pattern, the optic being further arranged to mechanically couple together the light source and reflectors to hold the light source, optic and reflectors in a predetermined spatial relationship.

9 Claims, 4 Drawing Sheets

(56) References Cited

U.S. PATENT DOCUMENTS

| | | | | |
|---|---|---|---|---|
| 6,755,556 | B2 * | 6/2004 | Gasquet | F21V 5/04 362/329 |
| 7,349,163 | B2 * | 3/2008 | Angelini | F21V 3/04 359/708 |
| 8,075,165 | B2 * | 12/2011 | Jiang | F21V 5/04 362/249.02 |
| 9,416,938 | B2 * | 8/2016 | Windom | F21V 5/04 |
| 10,014,435 | B2 * | 7/2018 | Kim | H01L 33/005 |
| 2004/0201025 | A1 * | 10/2004 | Barnett | F21V 3/04 257/79 |
| 2008/0087911 | A1 * | 4/2008 | Stoyan | F21K 9/00 257/99 |
| 2011/0156584 | A1 | 6/2011 | Kim | |
| 2011/0273892 | A1 * | 11/2011 | Mostoller | F21V 17/06 362/311.01 |
| 2013/0083525 | A1 | 4/2013 | Koo et al. | |
| 2013/0188362 | A1 | 7/2013 | Howe | |
| 2013/0279157 | A1 | 10/2013 | McDermott | |
| 2015/0316228 | A1 * | 11/2015 | Saito | F21V 5/045 362/311.06 |

* cited by examiner

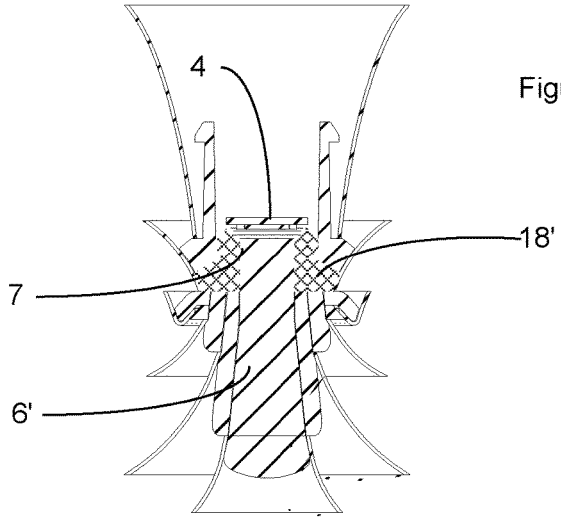
Figure 4A
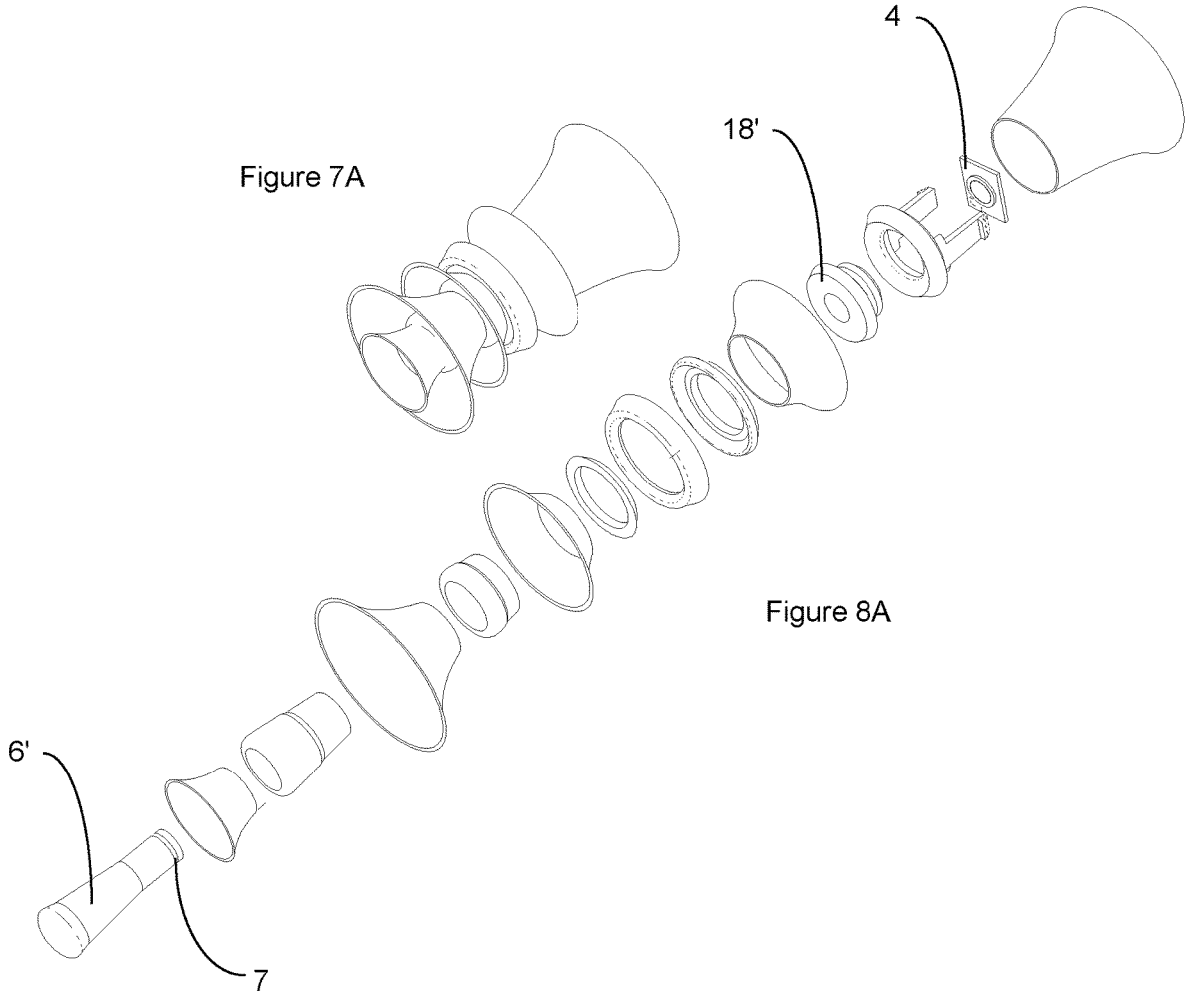
Figure 7A
Figure 8A

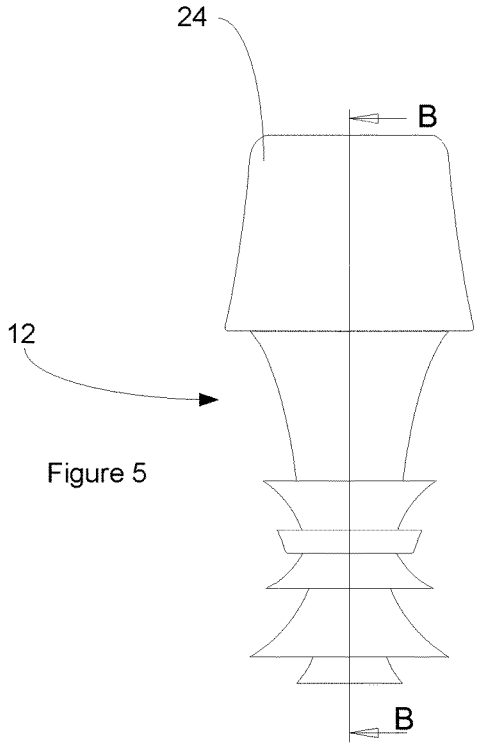
Figure 5
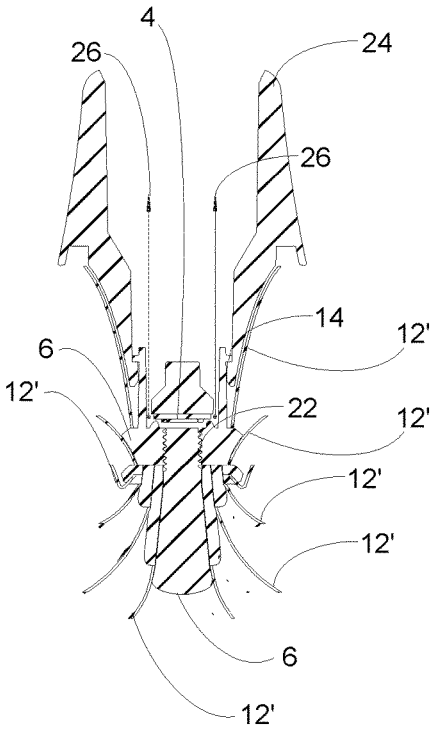
Figure 6
Figure 7
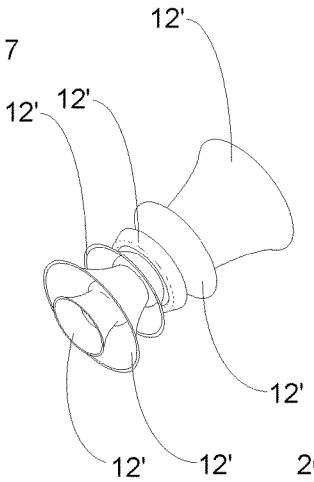
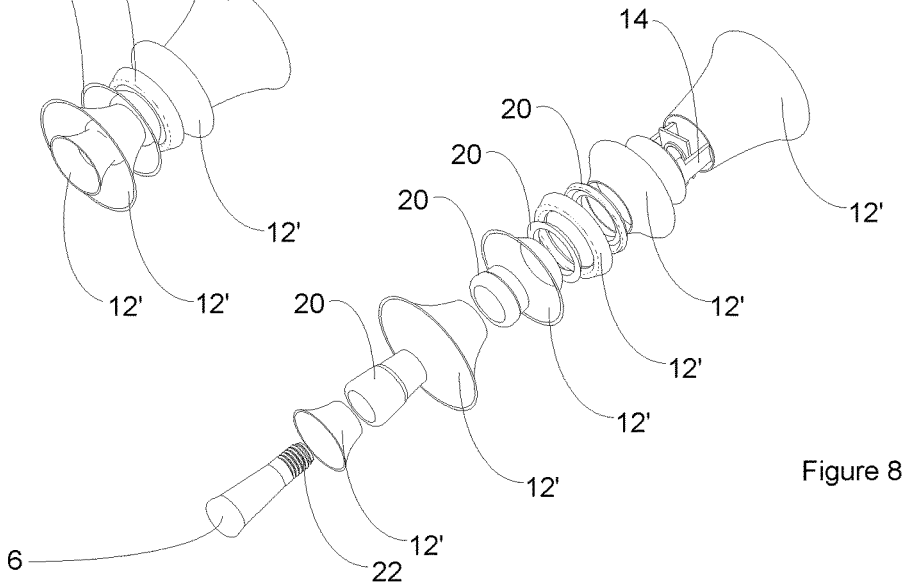
Figure 8

LIGHT UNIT

CROSS-REFERENCE TO RELATED APPLICATIONS

The present application claims priority to PCT International Application No. PCT/GB2017/050130 filed on Jan. 19, 2017, which claims priority to GB1603101.5 filed Feb. 23, 2016, the entirety of the disclosures of which are expressly incorporated herein by reference.

STATEMENT RE: FEDERALLY SPONSORED RESEARCH/DEVELOPMENT

Not Applicable.

FIELD OF THE INVENTION

This invention relates to a light unit for use in a building having mechanical coupling of a hybrid system consisting of an arrangement of optical parts (referred to as "optic") and reflective elements (referred to as "reflectors") functioning as lens, reflector and structural element to allow adjustment of light from a directional source.

BACKGROUND OF THE INVENTION

Current general purpose or decorative lighting solutions for use in buildings and the like, use a light source and either optical parts such as lenses and waveguides hereinafter referred to as "an optic", a diffuser or an arrangement of reflectors to change the direction of the light. These methods suffer from one or more problems such as an unattractive aesthetic appearance, a high part count which increase manufacturing costs, shadow-casting structural elements which provide poor output light distribution, fixed colour correlated temperature (CCT) and limited control over the directionality of the light.

DE202012008322U shows a modular LED lamp with a socket for plugging directly into a standard socket such as a GU10 or Edison Screw fitting, an LED and a drive circuit for the LED. It is designed to allow easy repair or a change of socket type and shows a releasable mechanical connection between two housing parts which are a heatsink and a plastic housing. The heatsink carries the socket and drive circuit and the plastic part carries the LED. The two housing parts have electrodes to carry current between the parts.

US2013/0083525 shows a cascaded bayonet fitting used to attach a diffuser to an LED light source and then a reflector to the diffuser. The diffuser may instead be omitted and the reflector coupled directly to the light source.

WO2014/094061 shows an LED downlighter having a 3-legged form carrying a diffuser which is mounted to a reflector. The housing forms a heatsink and contains the driver circuit. The reflector and diffuser may be made as a single, moulded part. A light source PCB and the reflector are separately mounted to the housing.

US2013/0279157 shows a removable optic design typically for a torch (flashlight) to allow a user to switch between a broad spread of light or a more directed beam.

The present invention provides the benefits of both reflector and optic while allowing for a reduced component count. It typically also gives a large variation in direction, CCT and/or intensity of light.

SUMMARY OF THE INVENTION

A light unit for general purpose or decorative lighting having a directional light source, a light transmissive optic arranged to direct light from the light source and a plurality of reflectors arranged to receive light from the optic and/or light source and at least partially a reflect portion of the light in a predetermined distribution pattern, the optic being further arranged to mechanically couple together the light source and reflectors to hold the light source, optic and reflectors in a predetermined spatial relationship.

The reflectors are thus held in position without the need for additional structural elements, with the outcome of reducing part count and eliminating any shadows cast by non-refractive or reflective elements.

The light source is directional in the sense that it has an included angular light spread less than 180 degrees. It is typically of LED construction or may be a laser source which illuminates a light emitting surface which then emits in the visible spectrum. This could be a single point source, a light emitting surface or an array of sources in single or multiple CCTs and either addressed individually, as a group or a combination of both. Illumination in different combinations allows the light path through the reflectors to be varied and/or may change the colour emitted.

The arrangement of optical parts ("optic") acts as a lens and a structural component, having a polished or diffused surface finish, either clear, tinted or diffuse and connected together through use of a threaded section, a snap feature, an interference fit, adhesive or any other fixing method.

The reflectors are supported by the optic and are arranged to direct and/or colour the light emitted from the source and/or optical arrangement. The light colour may be changed using multiple reflections which may have the effect of lowering the colour temperature.

The optics also preferably form the mechanical attachment method to a heat sink. Typically, the optic eliminates any tolerances in the supported reflectors through its assembly method.

Preferably in use, an adjustable proportion of the light is reflected behind the source while maintaining a spot light at 0 degrees, which is achieved by alternating the angle of the reflectors. The CCT may be varied from 0 degrees outwards based on the angle of the reflector and by varying the materials and finishes used as reflectors.

By adjusting the relative output of the directional light source it is possible to adjust both colour and/or directionality of light with a static arrangement (no moving parts). Typically, the optic to acts as the fixing between source and heatsink to ensure good thermal contact and correct alignment. Preferably, the positioning of the reflector and optics eliminates direct line of sight to the light source which reduces undesirable glare when looking at the light unit.

DESCRIPTION OF THE FIGURES

The invention will now be described by way of example and with reference to the drawings in which:

FIG. 4A is a section along line A-A of FIG. 3 of an alternative embodiment;

FIG. 5 is a side elevation of an assembled light unit;

FIG. 6 is a section along line B-B of FIG. 5;

FIG. 7 is a perspective view of an assembled light unit;

FIG. 7A is a perspective view of an alternative embodiment of an assembled light unit;

FIG. 8 is an exploded view of FIG. 7;

FIG. 8A is an exploded view of FIG. 7A;

DETAILED DESCRIPTION

Figure 1:
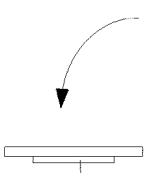
FIG. 1 is a side elevation of a light source.
Figure 2:
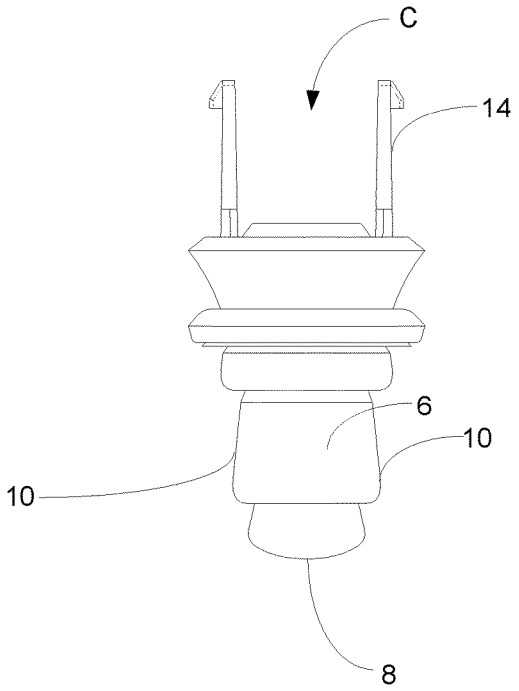
FIG. 2 is a side elevation of a light optic.

With reference to FIG. 1, a light source 2 has a light emitting surface 4 which is typically a chip on board (COB) LED. This type of light source is directional and typically emits light in an arc of 180° or less. With reference also to FIG. 2, this light source is fitted into the upper part C of an optic 6.

One function of the optic 6 is to collect and direct light emitted by the LED 4 and allow it to be refocused and diffused in a controlled manner. In this particular embodiment, light is emitted through a lens structure 8 and also allowed to diffuse sideways through walls 10.

Figure 3:
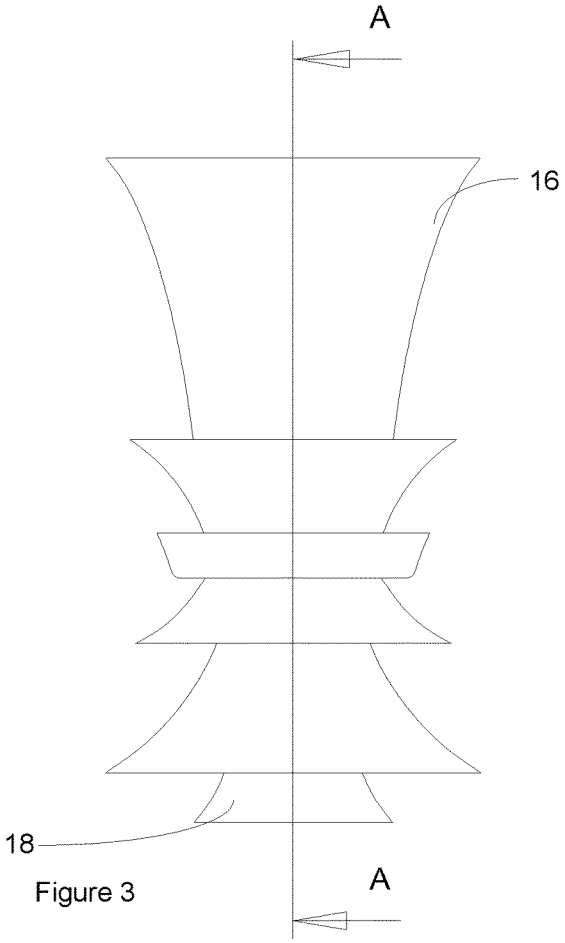
FIG. 3 is a side elevation of a reflector showing each reflector part without other components visible.
Figure 4:
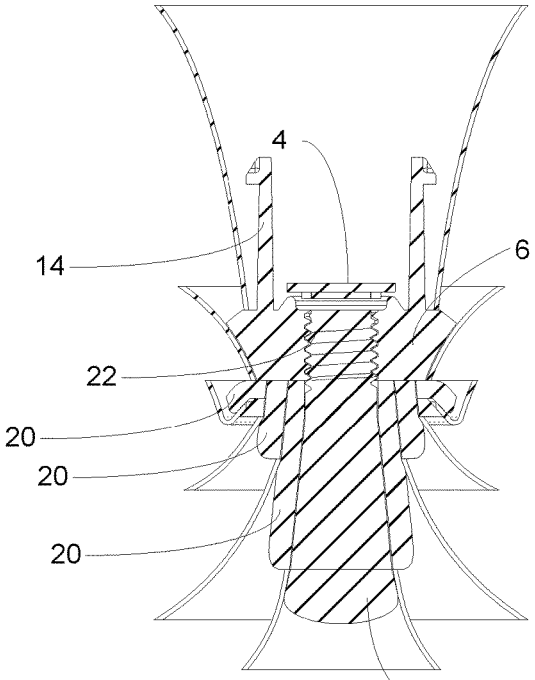
FIG. 4 is a section along line A-A of FIG. 3.

The optic 6 is designed to be located inside a reflector arrangement 12 as shown in FIG. 3. With reference also to FIG. 4, the location of the optic 6 within the reflector 12 is shown and barbed constructions 14 formed using the optic material, can be seen to engage with the upper part 16 of the reflector. In this way, the reflector 12 and optic 6 engage one another and are held in a predetermined mechanical relationship. An optic nut 18 is then threaded into the upper part of the optic 6 and allows the light source 2 to be held adjacent to the input surface of the optic 6. The threaded configuration is one example. An interference fit with a deformable material such as silicon rubber is another alternative as described in more detail below. These arrangements allow for the light source 2 to be held close to the optic 6 despite variations in manufacturing tolerances.

In an alternative embodiment and with reference to FIG. 4A, a resilient O-ring 18' (cross-hatched in FIG. 4A for clarity) is preferably formed from a silicon rubber material, and is arranged to engage a circumferential discontinuity, preferably in the form of a groove 7, formed in the outer surface of an optic 6' at its inner end. This provides an interference fit between the reflectors, light source and optic. This combination then replaces the optic nut and threaded part of the optic in the embodiment of FIG. 4. This then allows easier assembly via a push-fit rather than threading operation, and obviates the need to form a thread on the optic 6.

With reference to FIGS. 5, 6, 7 and 8, the detailed construction of the light unit is shown. The reflector 12' has multiple parts of varying angles against the 0° line shown as the axis B in FIG. 5. These are held in the correct spacial relationship by shaped washers 20 and the whole is then clamped together by the threaded interconnection 22 between the two parts of the optic 6. The different parts of the reflector are shown in more detail in FIG. 7. FIG. 8 shows the whole assembly in exploded form including the optic and all the washers 20.

With particular reference to FIG. 6, the barbs 14 are preferably arranged to engage a heat sink 24 which draws away heat from the light source 2 and allows it to be radiated above the light unit. FIG. 6 also shows power leads 26 brought in to the top of the light unit 4 supplying power and as appropriate, control signals to the light source 2.

The heat sink 24 may instead of engaging with the optic, may instead engage with the light source or indeed may be an integral part of the light source.

In this way, it will be seen that the light unit formed by these three components, has no additional parts required to hold the unit together. The optic serves to allow the optic and reflector to be held together and at the same time the light source is also held in place and all are held in appropriate spatial relationships so that the reflector operates in the way it is designed with appropriate distribution of light.

Typically the optic is formed from a transparent or translucent plastics material with a known refractive index and is designed to control the light path from the light source to the reflector 12. Similarly the inner surfaces of the reflector 12 are shaped and have surface finishes to produce a predetermined direction and/or diffusion of the light to produce a desired light distribution. The reflector 12 is also preferably designed so that no part of the light source is directly visible so that glare from the LED 4 is minimised or completely avoided.

Also, by appropriate choices of surface finishes of the reflector 12 and possibly of optic materials, the colour temperature of the light emitted by the unit may be controlled and may be varied with viewing angle.

FIGS. 7A and 8A shows the same parts described above but with the alternative embedment of FIG. 4A in which the optic nut and threaded part of the optic are replaced with a silicon O-ring 18' which engages the inner end of the optic 6'

Figure 9:
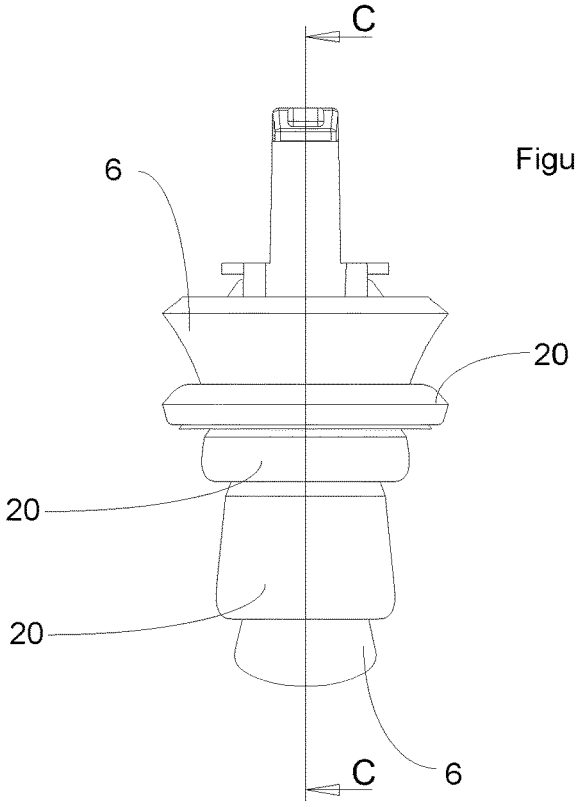
FIG. 9 is a side elevation of an assembled optic component.
Figure 10:
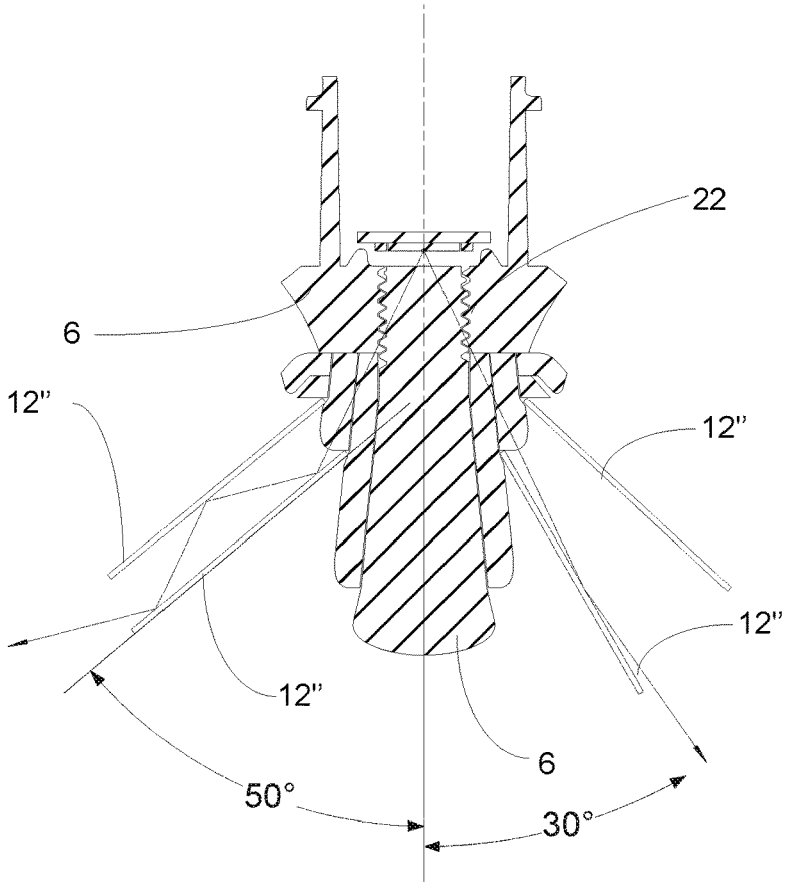
FIG. 10 is a section along line C-C of FIG. 9 with various schematic reflectors shown also in section.

With reference to FIGS. 9 and 10, generic straight reflectors 12" are shown in order to demonstrate the effect of varying the reflector angle relative to the central 0° axis E.

It will be seen in the left side of FIG. 10 that by providing reflectors with a larger angle (50° in this example) the light emitted from the light source 2 is caused to undergo multiple reflections. Whereas on the right side of the Figure with a reflector angle of only 30°, the light undergoes only a single reflection. In this way, the effect of the reflections may deliberately be multiplied by designing the reflectors to cause a known and pre-determined number of reflections. At each reflection, the quality of the light is altered and thus intensity and colour of the light may be varied both with the material choices and surface finishes of the reflectors 12; and also with their shaping to cause a desired number of reflections before the light exits the light unit.

Furthermore, in combination with a light source having switchable arrays of light, further combinations of light paths and colour outputs may readily be achieved. This is because the light array may allow the light emitted from the light source to start from a different point which means that it can be designed to have a different reflections in combination with the designed angle of the reflectors.

The invention claimed is:

1. A light unit for general purpose or decorative lighting having a directional light source, a light transmissive optic arranged to direct light from the light source and a plurality of reflectors arranged to receive light from the optic and/or light source and at least partially reflect a portion of the light in a predetermined distribution pattern, the optic being fluffier arranged to mechanically couple together the light source and reflectors to hold the light source, optic and reflectors in a predetermined spatial relationship.

2. A light unit as claimed in claim 1 further including a heatsink thermally coupled to the light source and wherein the optic is arranged to mechanically engage and hold the heat sink in place.

3. A light unit as claimed in claim 1, wherein the optic is arranged to hold the reflectors in place and the distance between the light source and the optic is adjustable to allow for manufacturing tolerance.

4. A light unit as claimed in claim 1, wherein the reflectors are arranged to cause a predetermined proportion of the light to be reflected behind the light source while maintaining a spot light at 0 degrees.

5. A light unit as claimed in claim 1, wherein the reflectors are arranged to vary the CCT of the light from 0 degrees outwards using predetermined variations in reflector angle and/or reflector materials and/or surface finishes.

6. A light unit as claimed in claim 1, wherein the light source is arranged to permit adjustment of its relative output to adjust the colour and/or directionality of light emitted from the unit such as by switching different parts of the light source to move the emitted beam spatially and/or in initial CCT.

7. A light unit as claimed in claim 1, wherein the positioning of reflectors and optic relative to the light source is arranged to eliminate direct line of sight to the light source.

8. A light unit as claimed in claim 1, wherein the optic mechanically couples together the light source and reflectors using a threaded coupling.

9. A light unit as claimed in claim 1, wherein the optic mechanically couples together the light source and reflectors using an interference fit.

* * * * *